US005088307A

United States Patent [19]

Cole

[11] Patent Number: 5,088,307

[45] Date of Patent: Feb. 18, 1992

[54] METHOD OF MAKING MUNTIN BARS

[76] Inventor: Richard D. Cole, 40 Santa Barbara Dr., Plainview, N.Y. 11803

[21] Appl. No.: 630,517

[22] Filed: Dec. 20, 1990

[51] Int. Cl.[5] ..... B21D 5/00

[52] U.S. Cl. ..... 72/46; 52/312; 52/456; 29/897.312

[58] Field of Search ..... 72/46, 307, 379.2; 29/897.312, 897.3; 52/456, 312, 313; 49/381, 504

[56] References Cited

U.S. PATENT DOCUMENTS

| | | | |
|---|---|---|---|
| 2,156,107 | 4/1939 | Bowman | 72/46 |
| 3,438,110 | 4/1969 | Lavallée | 29/897.312 |
| 3,832,962 | 9/1974 | Rolles | 72/46 |
| 4,070,885 | 1/1978 | Miyamatsu et al. . | |
| 4,160,348 | 7/1979 | Chapman et al. . | |
| 4,381,726 | 5/1983 | Hojberg . | |
| 4,450,661 | 5/1984 | Whitener . | |
| 4,455,850 | 6/1984 | Switten | 72/46 |
| 4,624,085 | 11/1986 | Thosath . | |
| 4,625,479 | 12/1986 | Giguere . | |
| 4,628,582 | 12/1986 | Leopold . | |
| 4,698,891 | 10/1987 | Borys . | |
| 4,702,050 | 10/1987 | Giguere . | |
| 4,719,728 | 1/1988 | Erikson et al. . | |
| 4,723,388 | 2/1988 | Zieg | 52/456 |
| 4,753,041 | 6/1988 | Adell . | |
| 4,773,184 | 6/1988 | Adell . | |
| 4,912,837 | 4/1990 | Bayer . | |

FOREIGN PATENT DOCUMENTS

| | | | |
|---|---|---|---|
| 115624 | 6/1986 | Japan | 72/46 |
| 1326365 | 7/1987 | U.S.S.R. | 72/46 |

*Primary Examiner*—David Jones
*Attorney, Agent, or Firm*—Kane, Dalsimer, Sullivan, Kurucz, Levy, Eisele and Richard

[57] ABSTRACT

A method of manufacturing a muntin bar having different colors on opposite sides thereof including the steps of applying equal proportions of paint to a coil from which material is slit to form the muntin bars, slitting said coil in a dimension sufficient to form the bar and forming the material into a rectangular shape bar.

5 Claims, 2 Drawing Sheets

METHOD OF MAKING MUNTIN BARS

FIELD OF THE INVENTION

The present invention relates to a method of making decorative hardware, in particular muntin bars.

BACKGROUND OF INVENTION

The fabrication of windows, particularly insulating glass windows usually involves the use of two sheets of glass having an air buffer therebetween. Often times it is desirable to provide muntin bars on the windows to create the impression of smaller panes. The muntin bars used may be fabricated out of wood, metal or plastic The muntin bar is typically painted to match the framing of the window. Normally this is white or a dark color. However, it is often desirable to have one color on one side to match the color of the outside of the window and another color to match the interior of a different color.

In situations when the muntin bar is disposed within the insulating glass, painting must be done prior to fabrication. If the muntin bars are positioned outside of the insulated glass, the bars may be painted subsequent to fabrication. Most muntin bars are painted one color and placed in the window regardless of whether or not the window trim has a different color.

SUMMARY OF THE INVENTION

It is therefore a principle object of the invention to provide for a means of making muntin bars having different colors on opposite sides which is relatively simple and inexpensive.

It is a further object of the invention to provide for such a muntin bar which allows for its manufacture with existing manufacturing process for such bars, particularly muntin bars fashioned out of metal.

The present invention provides for such objectives by utilizing a method of manufacturing muntin bars which are painted with the desired color prior to fabrication. In the manufacture of muntin bars from metal coil (eg. aluminum) usually involves taking a wide coil and slitting it into narrow coils the width of which corresponds to the amount of material comprising the four sides of a rectangular muntin bar. The narrow coil is then formed into the rectangular shape. The invention involves determining the width of material making up the desired size of muntin bar and prior to slitting, painting the desired colors (eg. white and brown) on approximately one half the width. The coil is then slit and formed along a center axis which is the junction of the two different colored painted surfaces. This allows the fabricator to decide prior to fabrication what colors will make up each side of the muntin bar. As such a step is included in the manufacturing process without requiring additional machinery or otherwise disrupt existing manufacturing procedure. The result is that fabricators need adjust a change in the painting of the coil from a single color to a multi-color procedure, thus readily implementing it in existing processes.

BRIEF DESCRIPTION OF THE DRAWINGS

Thus by the present invention its objects and advantages will be realized, the description of which should be taken in conjunction with the drawings, wherein.

DETAILED DESCRIPTION OF THE PREFERRED EMBODIMENT

Figure 1:
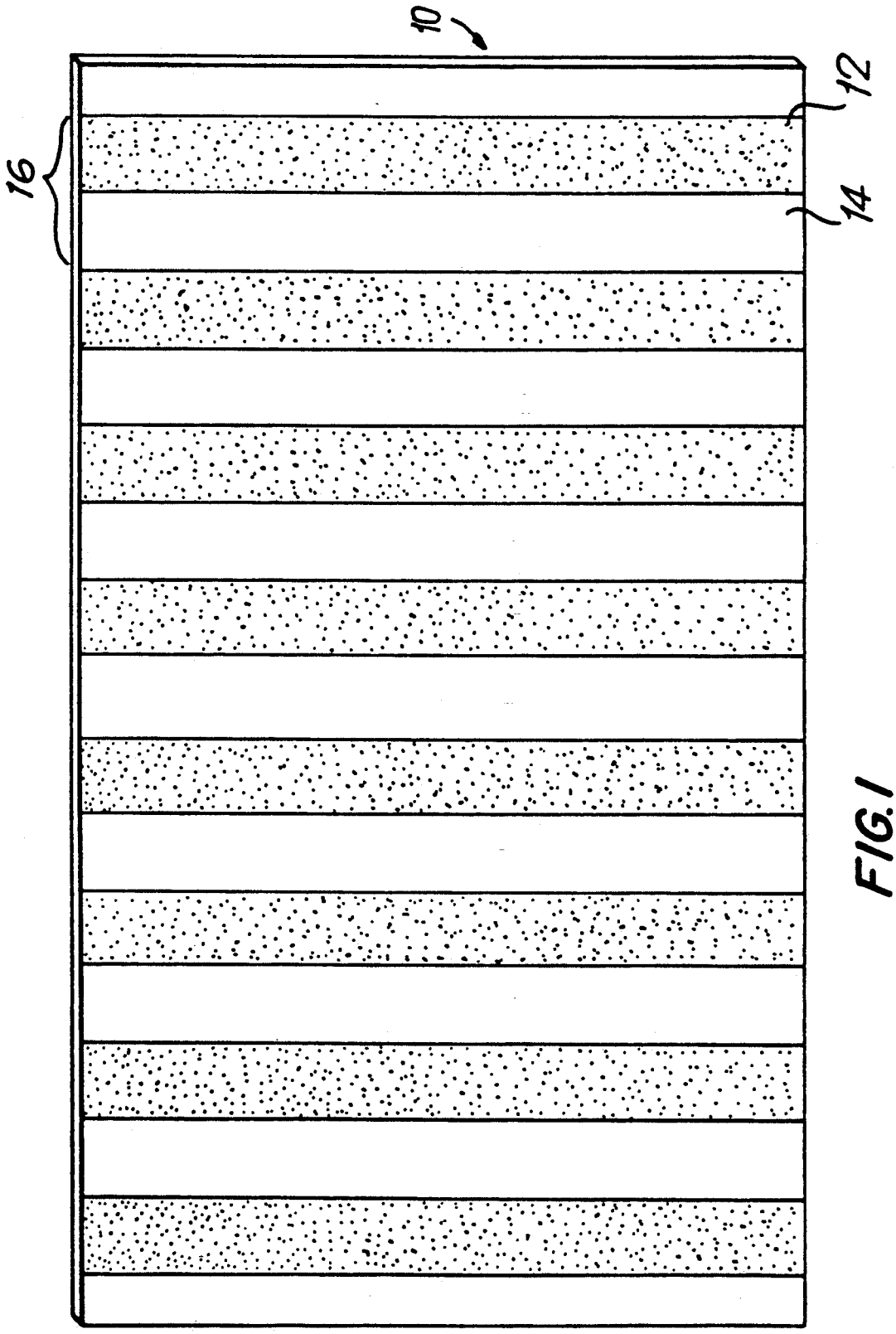
FIG. 1 is a perspective view of a wide coil of material repainted to provide the multi-colored muntin bar, incorporating the teachings of the present invention.

Turning now more particularly to the drawings, in FIG. 1 there is shown a sheet of material 10 which is made of metal, preferably aluminum. The sheet 10 normally is that taken off a coil of material which is processed into muntin bars. Typically the sheet width is approximately 24" but may be of any other size convenient to the manufacturing process.

Figure 2:
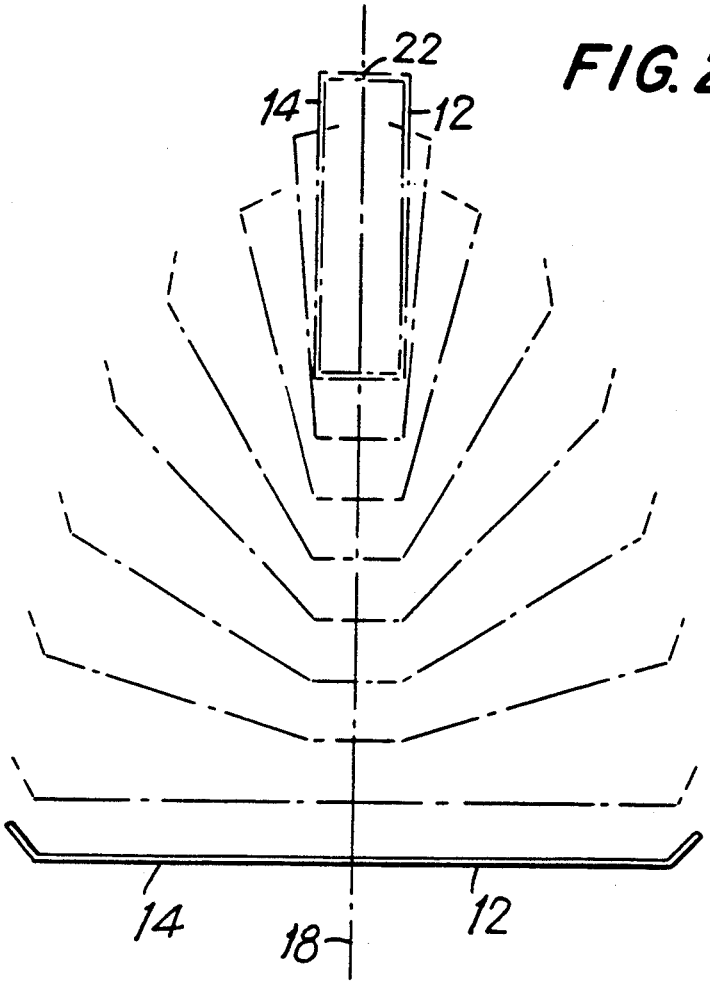
FIG. 2 is an end view of a slit coil of material shown in a successive folding process to form a rectangular muntin bar, incorporating the teaching of the present invention.
Figure 3:
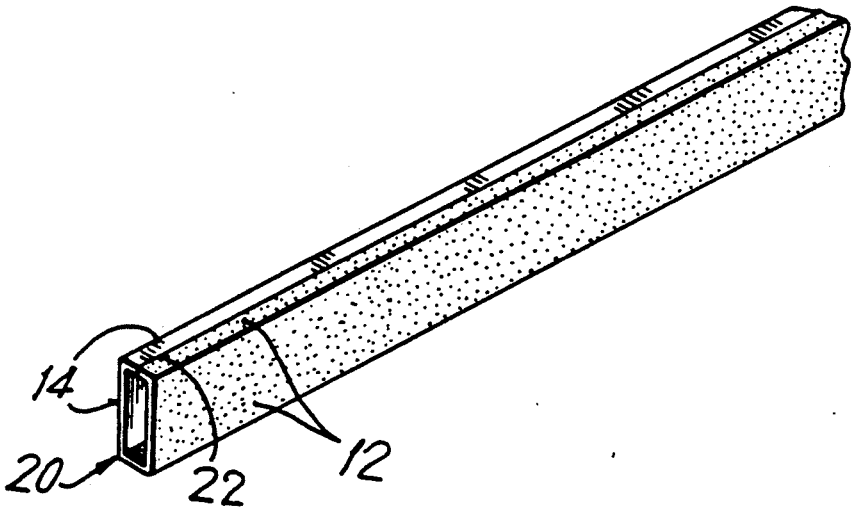
FIG. 3 is a perspective view of a multi-colored muntin bar, incorporating the teachings of the present invention.

The sheet 10 is processed by slitting it into narrow coils which are then formed into a rectangular shape to form the muntin bar. This forming process is illustrated in FIG. 2. Prior to slitting the sheet material is painted in the desired color. To effect a two tone muntin bar, the width of material used to form it is painted in substantially equal half in a first color 12 and a second color 14. This two color section 16 is then slit from the sheet 10 which is then subject to the forming process as shown in FIG. 2. In this process, axis 18 acts as a dividing line between the different colors so as to create a two tone or multi color muntin bar 20. Heretofore only a solid color would have been generated at the point of intersection of the formed ends 22.

Thus by the present invention its objects and advantages are realized and although a preferred embodiment has been disclosed and described in detail herein, its scope should not be limited thereby, rather its scope should be determined by that of the appended claims.

What is claimed is:

1. A method of making a muntin bar for use in windows comprising the following steps:

providing a sheet of formable material;

applying at least two different colors of material on substantially equal portions of the sheet of material; and forming the material into a rectangular shaped muntin bar such that each color is disposed upon opposite sides of the bar.

2. The invention in accordance with claim 1 which further includes the following steps:

wherein said providing step comprises providing said sheet from a coil of material with said sheet being of sufficient so width so as to be capable of forming a plurality of muntin bars;

wherein said applying step comprises applying said colors upon respective predetermined widths of the coil for each respective muntin bar to be formed;

slitting said sheet along said predetermined widths; and wherein said forming step comprises forming said predetermined widths into rectangular shaped muntin bars such that different colors are disposed on opposite sides of the bar.

3. The invention in accordance with claim 2 wherein said coil is made of metal.

4. The invention in accordance with claim 3 wherein said rectangular shaped muntin bars have four sides, two first sides of equal width and two second sides of shorter widths than the first sides, said different colors are disposed in approximately equal proportions on the shorter sides of the rectangular muntin bars.

5. The invention in accordance with claim 2 wherein the colored material applied is paint.

* * * * *

UNITED STATES PATENT AND TRADEMARK OFFICE

CERTIFICATE OF CORRECTION

PATENT NO. : 5,088,307

DATED : February 18, 1992

INVENTOR(S) : Richard D. Cole

It is certified that error appears in the above-identified patent and that said Letters Patent is hereby corrected as shown below:

Column 2, line 47, delete [so] first occurrence.

Signed and Sealed this

Twentieth Day of April, 1993

*Attest:*

MICHAEL K. KIRK

*Attesting Officer*

*Acting Commissioner of Patents and Trademarks*